United States Patent [19]

Merrill

[11] Patent Number: 4,852,878

[45] Date of Patent: Aug. 1, 1989

[54] TOY BLOCKS FOR MULTIPLE PUZZLES AND GAMES OF VARYING SKILL LEVELS

[76] Inventor: Jeffrey C. Merrill, P.O. Box 33, #363, Long Beach, Calif. 90801

[21] Appl. No.: 130,409

[22] Filed: Dec. 9, 1987

[51] Int. Cl.[4] ..... A63F 9/08

[52] U.S. Cl. ..... 273/156; 273/146; 273/273; 273/386

[58] Field of Search ..... 273/156, 157 R, 146

[56] References Cited

U.S. PATENT DOCUMENTS

| | | | |
|---|---|---|---|
| 46,525 | 2/1865 | Harold | 273/157 R U X |
| 487,063 | 11/1892 | Bailey | 273/156 |
| 487,798 | 12/1892 | Thurston . | |
| 646,463 | 4/1900 | Schossow | 273/156 |
| 1,121,697 | 12/1914 | Weil . | |
| 1,234,679 | 7/1917 | Littlefield . | |
| 1,412,204 | 4/1922 | Derby | 273/146 |
| 2,024,541 | 12/1935 | Silkman | 273/156 |
| 2,886,325 | 5/1959 | Long | 273/157 R |
| 3,222,072 | 12/1965 | Dreyer | 273/157 R |
| 3,547,444 | 12/1970 | Williams | 273/157 R X |
| 3,655,201 | 4/1972 | Nichols | 273/153 R |
| 3,672,681 | 6/1972 | Wolf | 273/157 R |
| 3,788,645 | 1/1974 | Nelson | 273/156 |
| 4,362,302 | 12/1982 | Gardner | 273/236 |
| 4,413,828 | 11/1983 | Gardner | 273/236 |

FOREIGN PATENT DOCUMENTS

| | | | |
|---|---|---|---|
| 4141 | 11/1895 | United Kingdom | 273/274 |

OTHER PUBLICATIONS

Excerpt from Puzzles and Paradoxes by T. H. O'Beirne; 1965 Oxford University Press, pp. 126–127.

Blockhead, copyright 1982 Pressman Toy Corp., New York, NY.

Jenga, a Milton Bradley Game, copyright 1986.

Master Mind, Pressman Toy Corp., New York, NY, copyright 1981.

Flip Out, Mattel, Inc. 1986 Hawthorne CA 90250.

Cosmic Wimpout, KBX Associates 1976.

Instant Insanity, no date.

Crazy Cubes, no date.

Addups, no date.

Snake Puzzle, no date.

Krakatoa, copyright 1983.

Rubik's Cube, no date.

Set of Six Blocks, photo and drawing, undated.

New Mathematical Pastimes, P. A. MacMahon, published 1921 by Cambridge Univeristy Press, Cambridge, England, pp. 42,43,46,47 relied on.

Mathematical Puzzles by Anthony S. Filipiak, copyright 1942, Bell Publishing Co., New York, pp. 109,110.

New Mathematical Diversions from Scientific American by Martin Gardner, copyright 1966, publ. by Simon and Schuster, New York, pp. 184–195.

*Primary Examiner*—Anton O. Oechsle

*Attorney, Agent, or Firm*—Price, Gess & Ubell

[57] ABSTRACT

Eight detached playing blocks have different indicia sequences. Each indicia sequence is different from one another. The indices in each sequence have a numerical character and a directional character to them. Varying numbers of playing blocks can be used to provide various puzzles and games with different levels of required skill.

12 Claims, 3 Drawing Sheets

TOY BLOCKS FOR MULTIPLE PUZZLES AND GAMES OF VARYING SKILL LEVELS

BACKGROUND OF THE INVENTION

1. Field of the Invention

The present invention relates generally to toy games and puzzles and, more specifically, to an improved apparatus for puzzles and games and improved methods of playing puzzles and games, the apparatus being capable of providing numerous mind challenging puzzles and games for many different levels of skill.

2. Description of Related Art

There have been numerous cube-type puzzles and games developed in the past which utilize cubes with various types of markings, such as colors or pictures depicting the four suits in a deck of playing cards. For example, U.S. Pat. No. 3,655,201 describes eight cube-type pieces that are magnetically engaged to one another, while adapted to rotate in complementary sets of four cubes about one of three mutually perpendicular axes. When the cubes are properly arranged, one distinct color on each of the six faces of the cubes is presented.

In U.S. Pat. No. 2,024,541, four independent cubes are provided with indices in the form of the four playing card suits. Additional markings are used on each of the cubes to easily distinguish one from the other and also to serve as a key to solving the puzzle. A similar type of puzzle is shown in U.S. Pat. No. 646,463.

A number of puzzles have utilized multiple indices on each face of several cubes which apparently adds dimensions to the game not otherwise present. Those puzzles require that the multiple indices on each face match with the multiple indices of adjacent faces. The use of multiple indices on a single face is shown, for example, in U.S. Pat. Nos. 3,788,645; 3,547,444; 1,121,697; 487,798; and 46,525.

While the number of block or cubic puzzles or games have been many in the past, players still seek features that provide multiple puzzles and games by a single apparatus or set of blocks. The prior puzzles and games have also lacked appeal to a wide range of skills in players. They have also lacked a wide number of solutions to each puzzle or game so that a player does not become bored upon finding the single solution or frustrated when the player cannot find the single solution.

A need still exists in the art to provide an improved apparatus for playing multiple puzzles and games, as well as methods for the same.

SUMMARY OF THE INVENTION

An object of the present invention is to provide an improved apparatus for multiple puzzles and games, and improved methods for providing puzzles and games.

Another object of the present invention is to provide multiple puzzles and games that can be enjoyed by players having varying skill levels.

A further object of the present invention is to extend a player's enjoyment by providing puzzles having multiple solutions.

An even further object of the present invention is to enable a player to devise his own games and puzzles by the use of the improved apparatus of the present invention.

The objects of the present invention can be accomplished by providing eight cubic elements which remain detached from one another, each cubic element having six faces, one of the cubic elements being a key element. Also provided are eight indicia sequences being associated with the cubic elements, each indicia sequence being different from one another and having six different indices that are characterized both numerically and directionly, the indices being arranged in side opposite pairs, the side opposite pairs of the key element being different from all other side opposite pairs, the indicia sequences being such that, when the cubic elements are arranged in a particular manner to form a cube-shaped configuration having six face planes, the indices appearing in any one face plane are of the same numerical character and of the same directional character.

These and other objects of the present invention can best be seen from an examination of the specification, claims, and accompanying drawings.

DETAILED DESCRIPTION OF THE PREFERRED EMBODIMENTS

The following description is provided to enable any person skilled in the puzzle and game fields to make and use the present invention and sets forth the best mode contemplated by the inventor of carrying out his invention. Various modifications, however, will remain readily apparent to those skilled in the art, since the generic principles of the present invention have been defined herein specifically to provide an improved apparatus for puzzles and games, as well as methods for providing the same.

Figure 1:
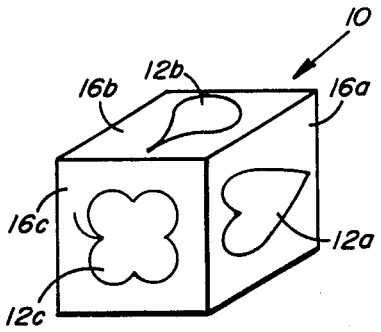
FIG. 1 is a perspective view of one of the playing elements of the present invention.

FIG. 1 depicts a single playing element 10 (sometimes referred to hereinafter as a "cubic element" or "block"). Playing element 10 has, in this particular embodiment, a cube-shaped configuration defined by six faces 16, three of which are shown in FIG. 1. An indicia 12 is on each face 16. As shown in FIG. 1, there are three indices 12*a*, 12*b*, 12*c* on respective faces 16*a*, 16*b*, 16*c*. Although not shown in FIG. 1, there are three other indices 12 on the remaining three faces 16.

As shown by the layouts of the blocks 10 in FIG. 2, the indices 12, in this particular embodiment, are represented by the configurations of a drop, a heart, a crown, a clover, a star, and a lightning bolt. As will be evident from the following discussion, other configurations for the indices 12 can be equally used. The indices 12 have both a numerical character and a directional character. For example, the drop indicia 12 represents a numerical value of one, and based on an apex 54 in the drop, it points in an upward direction, when viewed from FIG. 2*a*. The heart indicia 12 represents a numerical value of two in accordance with two lobe portions 55 and based on the apex 56 has a directional character of down, when viewed from FIG. 2*a*. The crown indicia 12 represents a numerical value of three based on three points 57 in the configuration and has a directional character that points to the right, when viewed from FIG. 2*a*. The clover indicia 12 represents a numerical value of four because of four lobes 60 in the configuration, and based on the stem portion 61 points to the right. The star indicia 12 represents a numerical value of five because of five points 58, and based on a top point 58′ opposite the two bottom points 58″ points upward, when viewed from FIG. 2*a*. The lightning bolt indicia represents a numerical value of six based on points 59 in its configuration and has a vertical character, when viewed from FIG. 2*a*.

Figure 2A:
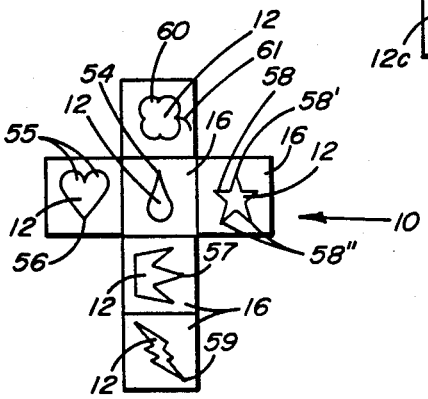
FIG. 2*a* diagrammatically shows an indicia sequence for a first block.
Figure 2B:
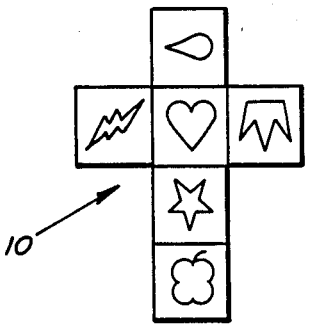
FIG. 2*b* diagrammatically shows an indicia sequence for a second block.
Figure 2C:
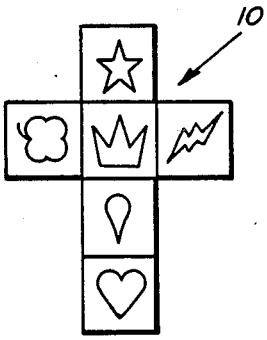
FIG. 2*c* diagrammatically shows an indicia sequence for a third block.
Figure 2D:
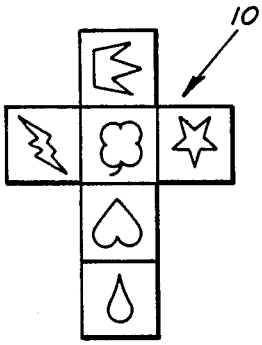
FIG. 2*d* diagrammatically shows an indicia sequence for a fourth block.
Figure 2E:
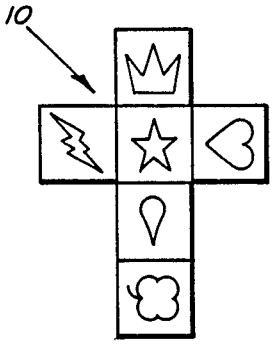
FIG. 2*e* diagrammatically shows an indicia sequence for a fifth block.
Figure 2F:
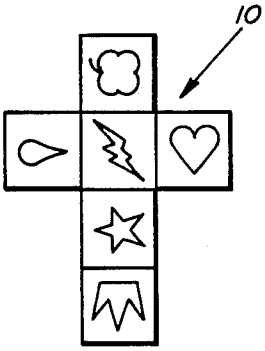
FIG. 2*f* diagrammatically shows an indicia sequence for a sixth block.
Figure 2G:
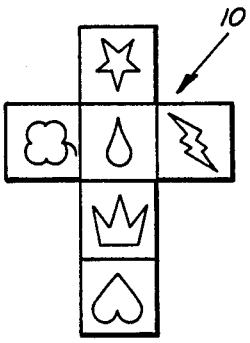
FIG. 2*g* diagrammatically shows an indicia sequence for a seventh block.
Figure 2H:
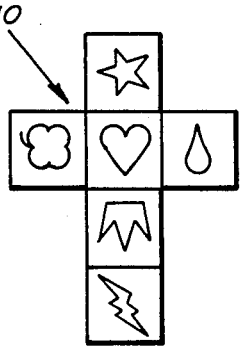
FIG. 2*h* diagrammatically shows an indicia sequence for a eighth block.

As can be seen by an examination of the remaining layouts of the seven other blocks 10, the indices 12 are arranged in different sequences which are unique from each other. Additionally, it can be seen that the blocks 10 provide three side opposite pairs of faces 16 or indices 12, which pairs are not repeated in any of the blocks 10 when considering both the numerical and directional characteristics of the indices 12. For example, in FIG. 2*b*, one pair consists of the heart and clover, another of the lightning bolt and crown, and a third of the drop and star. In FIG. 2*c*, one pair consists of a clover and lightning bolt, a star and drop, and a crown and heart. In FIG. 2*b* and FIG. 2*c*, each has a star and drop pair, but the stars and drops in each pair have different directional characters.

The indicia sequences, in this particular embodiment, have been generated by starting with a key block 10′ (FIG. 8) that represents a key to the solution of one of the puzzles described below. The key block 10′ is fashioned after standard dice in that the pairs total seven points when values are added together. As seen in FIG. 2*a* each side opposite pair numerically totals seven.

Figure 8:
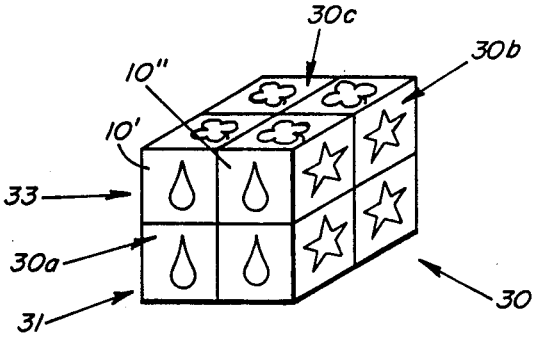
FIG. 8 represents a sixth puzzle that can be solved by the present invention.

To generate the indicia sequences of the other blocks 10, the blocks 10 may be placed in a cube-shaped configuration, as shown in FIG. 8. Thereby, six face planes 30 are created (three of which are shown in FIG. 8), each face plane being described by four faces 16 of four blocks 10. Each face plane contains each of the six sides of the identical indices in both numeric and directional characteristics.

The key block 10′ represents the particular directional and numeric character of the indices in each of the face planes of the cube shown in FIG. 8. The key block 10′ is thus the first block inserted into the cube. Then, a second block 10″ is placed in the cube which exposes three faces 16. The particular indices 12 on the three exposed faces are determined by matching the indices on the key block 10′. For example, in FIG. 8, the second block 10″ is in the upper right-hand corner of the cube. Thereby, the second block 10″ exposes a drop pointing upward in the face plane 30*a* a star pointing up in the face plane 30*b*, and a clover pointing right in the face plane 30*c*. The remaining blocks are similarly added to the cube and the indices on their respectively exposed faces similarly determined.

For the three remaining faces 16 that are hidden upon each block 10 being placed in the cube, other than for the key block 10; the indices 12 are selected so that the resulting side opposite pairs are not repeated with regard to either numerical character or directional character in any of the blocks 10 or key block 10′. As noted above, all the indicia sequences for this particular embodiment are shown in FIG. 2.

Figure 3:
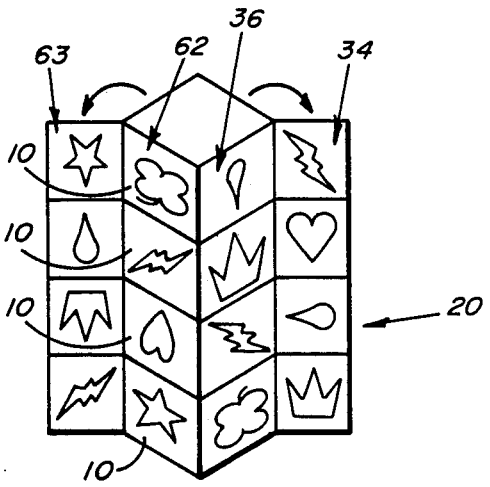
FIG. 3 represents a first puzzle that can be solved by the present invention.

For the particular number of blocks 10 used in this embodiment, namely eight, several puzzles can be played by a solitary player. In a first puzzle 20, as shown in FIG. 3, four blocks 10 are randomly stacked one upon another in an end-to-end relationship. Other numbers of blocks 10 can be used, as will become evident. In the stacked relationship, the faces 16 of the blocks 10 provide four face planes, 34, 36, 62, 63, two of which have been laid open for view, as indicated by the arrows in FIG. 3. The object of the puzzle 20 is to rearrange the blocks to provide in each of the four face planes, four different types of indices 12. For example, in the face plane 34, the four different types of indices are the lightning bolt, crown, heart, and drop. In the face plane 36, the four different types of indices are the clover, drop, crown and lightning bolt. The puzzle 20 can be played and solved with up to six blocks 10.

Figure 4:
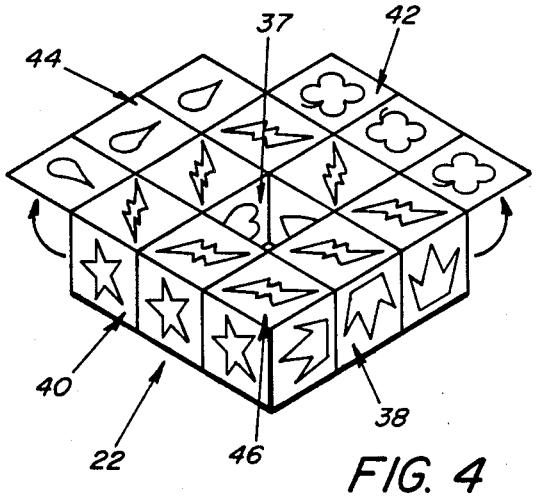
FIG. 4 represents a second puzzle that can be solved by the present invention.

A second puzzle 22 is shown in FIG. 4. The eight blocks 10 are randomly arranged in the configuration of a perimeter of a square that describes an inner area 37. Such a configuration also provides five face planes which are shown in FIG. 4 and indicated by the numerals 38, 40, 42, 44, 46. Two of the face planes have been laid open for view, as indicated by the arrows. The player moves one or more blocks 10 relative to the others so that the same type of indices 12 shows in each of the five face planes. Also, the same type of indices 12 must face into the inner area 37. For example, in FIG. 4, only crowns are shown in the face plane 38, only lightning bolts are shown in the face plane 46, only stars are shown in the face plane 40, only drops are shown in the face plane 44, and only clovers are shown in the face plane 42. Hearts face the inner area 37. However, the puzzle 22 does not require that the indices in each face plane align in the same direction, like that described with regard to FIG. 8.

Figure 5:
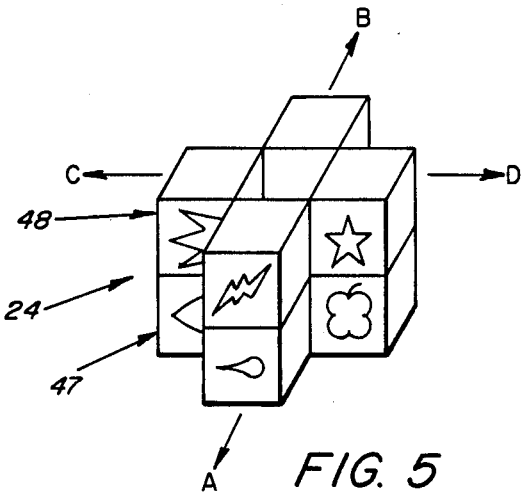
FIG. 5 represents a third puzzle that can be solved by the present invention.

In a third puzzle 24, as shown in FIG. 5, the eight blocks 10 are randomly arranged in a cross-shaped configuration having a first layer 47 and a second layer 48. The first layer 47 includes four blocks 10 arranged in a cross-configuration while the second layer 48 is similarly formed on top of the first layer, when viewed from FIG. 5. With the blocks 10 so arranged, four different directions are provided outwardly in directions from the center of the cross-configuration, the directions being denoted by arrows A, B, C, D. The object of the puzzle 24 is to provide the six different indices 12 on the six faces 16 facing out along the directions A, B, C, D. For example, in FIG. 5, in direction A, a drop, a clover, and a heart is shown in the first layer 47. In the second layer 48, a crown, a lightning bolt, and a star face in direction A. In a similar fashion, each of the six different types of indices will face outwards in the other directions B, C, and D. While puzzle 24 is shown in this particular embodiment as having a first layer 47 and a second layer 48, it is contemplated that a variation of the puzzle 24 can be played with only a single layer and only three different types of indices need face outwards in each of the four directions.

Figure 6:
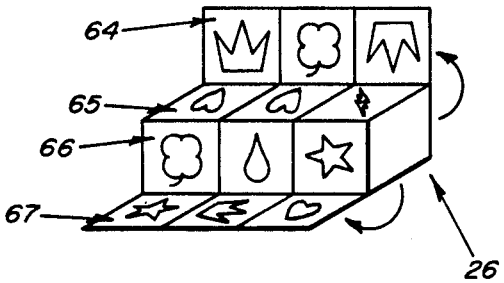
FIG. 6 represents a fourth puzzle that can be solved by the present invention.

A fourth puzzle 26 is shown in FIG. 6. Although various numbers of blocks 10 can be used, in this particular embodiment, three blocks 10 are used and randomly aligned in an end-to-end relationship to thereby provide four face planes 64, 65, 66, 67. Two face planes are laid open for view, as indicated by the arrows in FIG. 6. A numerical sum is first determined, such as ten. One or more of the blocks 10 are then rotated in any direction. The object of the puzzle 26 is to arrange the blocks 10 so that in each of the four face planes, the sum of the numerical values of the indices in each face plane equals the predetermined numerical sum. In FIG. 6, for example, the predetermined numerical sum is ten. On the face plane 66, a clover, a drop, and a star are shown. On the face plane 65, two hearts and a lightning bolt are shown. On the face plane 64, two crowns and a clover are shown. On the face plane 67, a star, a crown, and a heart are shown. All of the face planes 64, 65, 66, 67 consist of indices totaling the numerical sum of ten.

Figure 7:
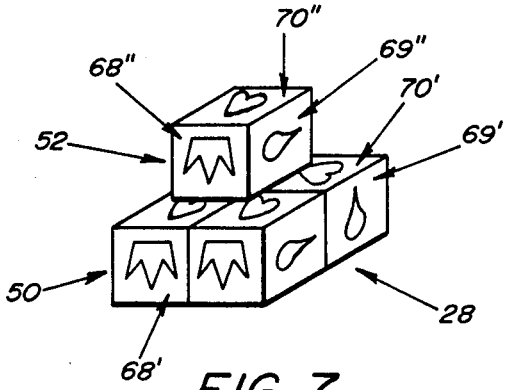
FIG. 7 represents a fifth puzzle that can be solved by the present invention.

In FIG. 7, a fifth puzzle 28 is shown wherein the blocks 10 are arranged in a first layer 50 and a second layer 52. The first layer 50 includes four blocks 10 arranged in a square configuration, while the second layer 52 includes only a single block 10, which must be the key block 10'. The first layer 50 provides five first face planes (three of which are shown and denoted 68', 69', 70'). The second layer 52 has five second face planes (three of which are shown and denoted 68'', 69'', 70''). Each first face plane is respectively paired with a second face plane. In this embodiment, plane 68' is paired with plane 68'', plane 69' is paired with plane 69'', and plane 70' is paired with plane 70''. One or more blocks 10 are moved relative to the other blocks so that in any pair of face planes, all the indices in such pairs of face planes are of the same type. For example, in FIG. 7, the face planes 68', 68'' include crowns, the face planes 70', 70'' include hearts, while the face planes 69', 69'' include drops.

FIG. 8 represents a sixth puzzle 30, which has a first layer 31 and a second layer 33, both of which contain four blocks 10. The sixth puzzle 30 requires not only that each of the six face planes (three of which are denoted 30*a, b, c*) have the same type of indicia but also that the indices have the same directional characteristic.

The present invention not only provides various types of puzzles that may be played by a solitary player but it also provides games that can be played by multiple players. For example, one game might be played with any number of blocks as follows. A first player releases one block 10 from a given height onto a playing surface to expose a face 16 that faces up and away from the playing surface. That face represents a scoring face. The indicia 12 on that scoring face represents a score for that release. This score can change, however, on any subsequent sequential releases of the remaining blocks 10.

One of the strategies of the game is to alter the value of any previous release (or roll) by hitting it with a subsequently released block 10 in the hopes of changing the score on the prior block 10. For example, if one of the blocks 10 is released and turns up a scoring face which has a star, the player may release his next block 10 on top of it. The object of the game is to obtain the lowest numerical sum of the scoring faces for all the blocks 10. Therefore, a perfect score would consist of drop indices for each block released. As will be apparent, other features can be added to the game. For example, the rules may require that if a release of a block 10 results in two or more blocks showing a particular indicia (for example, lightning bolts), the player must release all of those blocks showing such indicia.

A second game can consist of utilizing less than or all eight blocks 10. On a player's turn, the player rolls, for example, all eight blocks 10 onto a playing surface. For example, on a first roll, the faces of the blocks facing away from the playing surface, i.e. the scoring faces, may show two drops, one heart, one crown, one clover and three stars. The object is to match in groups as many blocks having the same type of indicia on their scoring faces to score points. The first player to score a predetermined number of points wins. In the example above, the player would have the option of keeping the drops and the stars and re-rolling the other three blocks 10. A second alternative is to keep only the drops or only the stars and re-roll the rest. A third alternative is to re-roll all blocks 10. Any blocks that are matched by the same type of indicia are set aside and the remainder of the blocks re-rolled. Blocks that are set aside cannot be re-rolled. On any successive roll, up to a pre-selected number of rolls, the same options apply. If a player does not match all eight blocks by the end of the pre-selected number of rolls, the turn ends for that player. If all blocks are matched and scored, the player would get to continue that turn and score a predetermined number of bonus points for using all eight blocks. Scoring is based on the number of blocks matched and the type of indicia common to the group of matched blocks. Only matched blocks score points. The first scored block is used as the face value in the point value, while the others represent zero's. In the above example, two drops would represent a value of 10 and three stars would represent a value of 500. Blocks that cannot be matched remain unscored.

A third possible game that can be played according to the present invention with an even number of blocks 10. Each player selects an equal number of blocks 10 which each player places in a predetermined array or pattern. For example, the array may consist of an end-to-end relationship of four blocks. In such an array, a single scoring face is exposed on each block 10. Each player then arranges his respective blocks 10 within the array while hiding the arrangement from the other player. For example, the blocks 10 may be arranged in an end-to-end relationship array so that, from a left to right direction, the scoring faces in the array include a heart, a drop, a star, and a clover. Each player then has the opportunity to pose one question at a time to the other player to determine the sequence and type of indices from left to right. Preferably, the questions can be answered either in the affirmative or in the negative. A question answered in the affirmative entitles that player to ask another question. Once a question is answered with a negative, that turn ends. The players alternate in asking questions and providing answers, and the first layer to determine the other player's array of indices in the correct sequence of scoring faces wins.

A fourth game can be played by beginning with an even number of blocks 10. Each player selects an equal number of blocks 10. Each turn consists of each player simultaneously rolling one block 10 onto a playing surface. At the same time, one player chooses an alternative as to whether a scoring face on his block 10 will be of a numerical value that is greater or lower than the scoring face on the block of the opposing player. When the two blocks come to a stop after being rolled, the blocks are compared to determine a result, i.e., which of the two blocks has a greater numerically valued indicia on its scoring face. If the player making the choice matches his chosen alternative with the result, that player is awarded the two blocks. If the chosen alternative does not match with the result, there is no match, and the two blocks are awarded to the opponent. In the event that the two indicia are identical, they may be set aside and awarded to the next player who wins a turn. Players alternate taking turns making choices. A winning situation may be determined by the number of matches between the chosen alternatives and the results or until one player is left without blocks.

Figure 9A:
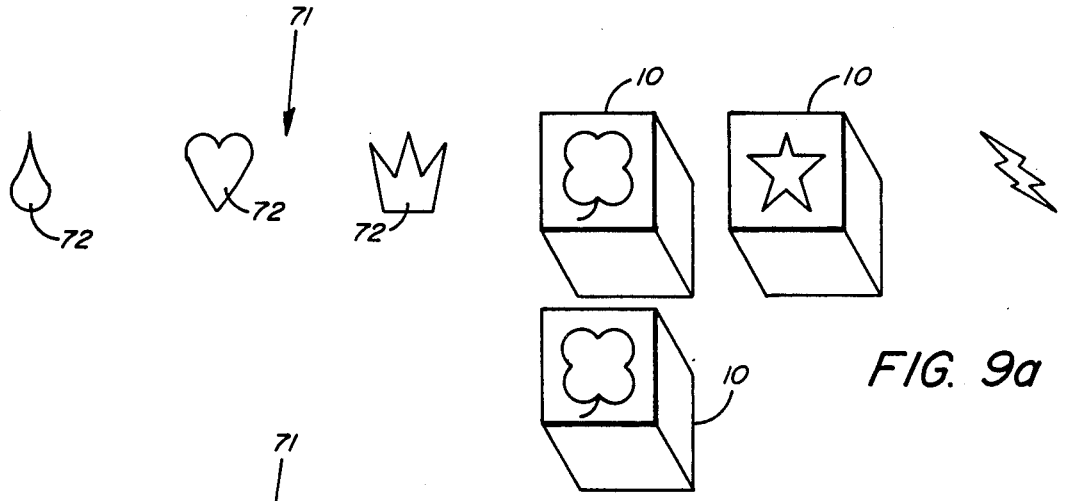
FIG. 9*a* depicts a possible step in one game that can be played according to the present invention.
Figure 9B:
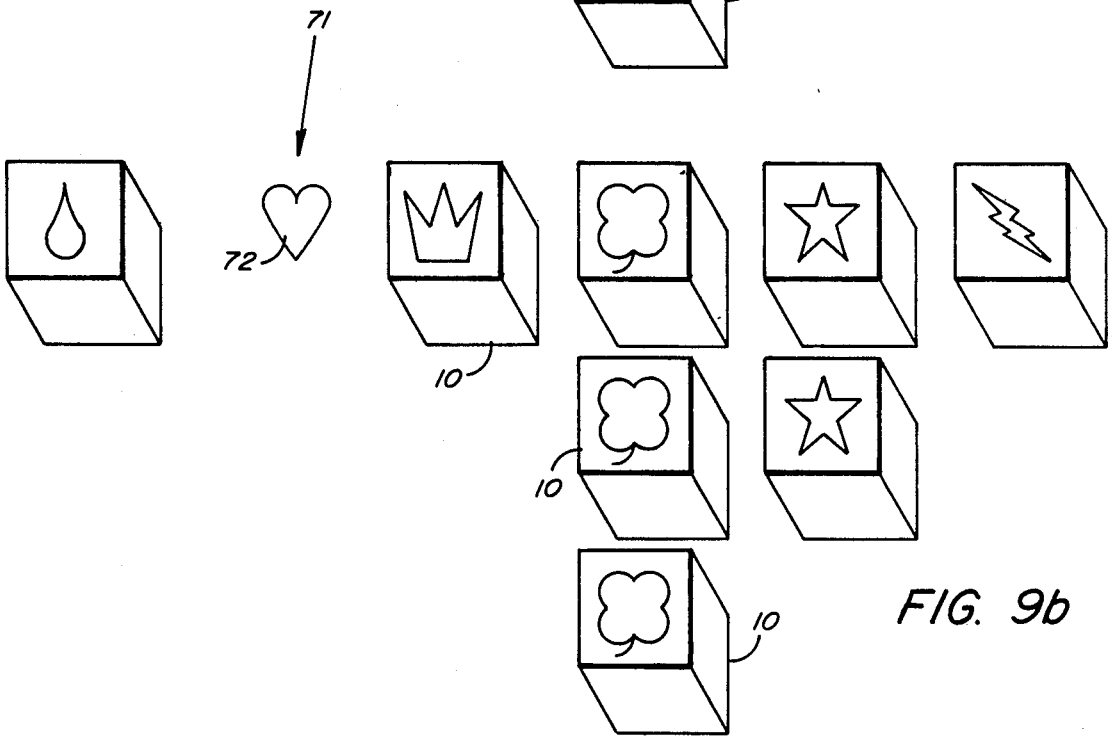
FIG. 9*b* depicts another possible step of the same game referred to in FIG. 9*a*.

A fifth game that may be played according to the present invention and begins by drawing representations 72 of each of the six indices in an array 71 on a playing surface. The indicia may, for example, be drawn in a line. One player begins by rolling or flipping one block and displaying a scoring face. For example, in FIG. 9*a*, if the first block that is rolled turns up a clover on the scoring face, the first block is then placed to cover the clover representation drawn on the playing surface. If the second block that is rolled exposes a star, then that block is placed to cover the star on the playing surface. If the third block that is rolled exposes a clover, then the third block may be placed outside of the array of representations, such as underneath the first clover as depicted in FIG. 9*a*. If, at any time, a subsequent roll of a block exposes a higher valued indicia than the preceding one, then a player may have the option of re-rolling a block that is not covering an indicia on the playing surface. For example, if the fourth block exposes a lightning bolt, the fourth block may be placed over the lightning bolt representation and the second clover outside of the array can be re-rolled. If a player rolls the same indicia twice in a row, that player gets to re-roll the second one. The object is to cover all of the indicia in the line or play for the lowest points. Points are awarded based on the numerical values of the representations that have not been covered (e.g., five points each) and on the numerical values of the blocks that are outside of the array (face value). For example, in FIG. 9*b*, 13 points may be awarded for the two clovers and star outside of the array and five points for not covering the heart.

Figure 10:
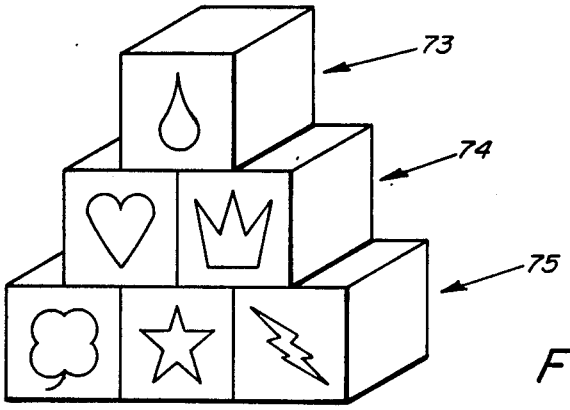
FIG. 10 represents part of another game that can be played by the present invention.

A sixth game may be played by providing the blocks in a pyramid configuration having three layers 73, 74, 75 of blocks, as shown in FIG. 10. In this particular embodiment, the front faces of the blocks show six different types of indices. A seventh block and, if needed, an eighth block are then rolled or flipped in an attempt to match the scoring face on the flipped block with the front face on the single block in the top layer 73. The player has two chances to match such top block by flipping one block at a time. If the player does not succeed in matching upon one of the two chances, the game ends. If the player is successful, the matched block is removed and the player then has three blocks which can be successively flipped to match the front faces in the second layer 74. Any match removes that block from its level and that block can be used to flip for another in that level. Once a player flips a block on a level, it cannot be used again on that level. The sequence of flipping and matching continues until all blocks in the pyramid have been matched. This game may also be played with more than three layers.

A seventh game may be played by providing up to eight or more blocks 10. The object of the game is to stack one block 10 at a time to construct a vertical column, similar to that shown in FIG. 3. Points are scored by adding together the top facing indicia 12 of each block 10 as it becomes part of the column. The blocks 10 are first randomly placed on a playing surface. Each player's turn consists of one or more rounds. Rounds are comprised of up to a certain number of moves, with each move being the addition of one block 10 to that player's column. If a player completes a column, for example, of eight blocks 10 high, the player may initiate a new round or stop his turn and score points. If one or more blocks 10 falls out of the column the player is building, that player's turn ends and no points are scored. A player also has the option of choosing not to continue building a column, especially in the event that the column constructed up to that point in time is unstable. The column is constructed by taking the previously stacked blocks 10 and placing such stack upon one other block 10. In the event that a player so terminates his turn before completing the column, the next player has the option of scoring the points in such partially completed column if the next player is able to add one or more blocks 10 to the column.

An eighth game can also be played by a plurality of blocks 10 (for example, six of them) to form a linear array, similar to that shown in FIG. 6. The blocks in the array are arranged in increasing numeric order based on the indicia facing upwards from a playing surface. For example, six blocks 10 are used and are arranged in increasing order from a numeric value of one to a numeric value of six. If, for example, a total of eight blocks 10 are used, play begins by taking one of the two blocks 10 not in the array, randomly choosing an indicia on such block, and matching it with a block in the array. If a match occurs, the matched block 10 in the array is removed. Such block 10 can then be randomly rolled for matching with another block 10 in the array. for example, a star may be matched on the first random selection. Then, after the star is removed from the array, that star is then used for another random selection to match with, for example, a drop in the array. To win, all of the blocks in the array must be removed.

The specifications above describe only preferred embodiments of the present invention, and it is contemplated that various modifications to the above can be effected but nevertheless come within the scope of the present invention as defined by the claims.

What is claimed is:

1. An apparatus that provides a plurality of puzzles and games, comprising:

at least six playing elements, each playing element having a plurality of faces; and a plurality of indicia sequences having numerically valued indices with directional characteristics, each indicia sequence being associated with a respective playing element so that each indicia in an indicia sequence is associated with a respective face of a playing element to thereby form a plurality of side opposite pairs, each side opposite pair being unique from all other side opposite pairs of the playing elements.

2. The invention of claim 1 wherein there are eight playing elements.

3. The invention of claim 1 wherein the numerically valued indices range from one through six.

4. The invention of claim 1 wherein each of the playing elements are of the same dimension.

5. The invention of claim 1 wherein one playing element is a key element whose side opposite pairs are different from each of the side opposite pairs in the other playing elements.

6. An apparatus that provides a plurality of puzzles and games, comprising:

a plurality of cubic elements, one of the cubic elements being a key element; and a plurality of indicia sequences being associated with the cubic elements, each indicia sequence having indices that are characterized both numerically and directionally, the indices being arranged in side opposite pairs such that the side opposite pairs of each cubic element are different from all other side opposite pairs when considering both numerical character and directional character, the different directional character being such that, if two side opposite pairs are the same numerically, and each indicia in the pairs having a first numerical character are aligned in a same direction, the other indicia in the pairs having a second numerical character have a different directional character in relation to one another, and each of the side opposite pairs of the key element being different from all other side opposite pairs when considering only the numerical character.

7. The invention of claim 6 wherein the directional character of an indicia represents one of four directions.

8. The invention of claim 10 wherein the numerical character of an indicia represents one of six different values.

9. The invention of claim 1 or 6 wherein the indicia include a drop, a heart, a crown, a clover, a star, and a lightning bolt.

10. An apparatus for games and puzzles, comprising:

a plurality of playing elements having a plurality of sides including opposing sides;

an indicia sequence associated with the sides of each of the playing elements, each indicia sequence having a unique plurality of non-Arabic numerical value and direction designating indicia when considering both directional and numerical characters of the indicia in each sequence, the directional character being such that, if two opposing side pairs of indicia in two sequences are numerically the same, and each indicia in the two pairs having a first numerical value are aligned in one directional character, the other indicia in the two pairs having a second numerical value have a different directional character in relation to one another.

11. The invention of claim 10 wherein the numerical character is one of at least six different values and the directional character is one of at least four different directions.

12. The invention of claim 11 wherein the indicia sequences form side opposite pairs which are all different from one another.

* * * * *